US008843018B2

(12) United States Patent
Wang

(10) Patent No.: US 8,843,018 B2
(45) Date of Patent: Sep. 23, 2014

(54) CLEANING MODULE AND PRINTER

(75) Inventor: Chih-Hwa Wang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 156 days.

(21) Appl. No.: 13/550,611

(22) Filed: Jul. 17, 2012

(65) Prior Publication Data

US 2013/0343778 A1 Dec. 26, 2013

(30) Foreign Application Priority Data

Jun. 20, 2012 (TW) ..... 101122042 A

(51) Int. Cl.
*G03G 21/00* (2006.01)

(52) U.S. Cl.
USPC ..... 399/101; 399/350

(58) Field of Classification Search
USPC ..... 399/101, 227; 101/118
See application file for complete search history.

(56) References Cited

U.S. PATENT DOCUMENTS

| | | | | |
|---|---|---|---|---|
| 7,284,479 | B2 * | 10/2007 | Sato | 101/118 |
| 7,835,651 | B2 * | 11/2010 | Tanaka et al. | 399/27 |
| 2008/0107442 | A1 * | 5/2008 | Tanaka et al. | 399/83 |
| 2010/0054814 | A1 * | 3/2010 | Sakurai et al. | 399/227 |

FOREIGN PATENT DOCUMENTS

| | | |
|---|---|---|
| TW | 344714 | 11/1998 |
| TW | 508315 | 11/2002 |
| TW | 1337136 | 2/2011 |
| TW | I339163 | 3/2011 |

* cited by examiner

*Primary Examiner* — Quana M Grainger
(74) *Attorney, Agent, or Firm* — Jianq Chyun IP Office

(57) ABSTRACT

A cleaning module and a printer using the same is provided. The printer includes a roller module, a transfer belt, a toner cartridge assembly and the cleaning module. The transfer belt is looped around the roller module. The toner cartridge assembly is disposed beside the transfer belt and suitable for rotating to a standby position or a coloring position. The cleaning module includes a frame, a linking-up unit and a scraping unit. The frame is disposed at the roller module. The linking-up unit is pivotally connected to the frame and suitable for contacting the toner cartridge assembly. The scraping unit is connected to the linking-up unit. When the toner cartridge assembly is at the standby position, the scraping unit is contacted to the transfer belt. When the toner cartridge assembly is at the coloring position, the scraping unit is separated from the transfer belt.

10 Claims, 5 Drawing Sheets

CLEANING MODULE AND PRINTER

CROSS-REFERENCE TO RELATED APPLICATION

This application claims the priority benefit of Taiwan application serial no. 101122042, filed on Jun. 20, 2012. The entirety of the above-mentioned patent application is hereby incorporated by reference herein and made a part of this specification.

BACKGROUND

1. Technical Field

The invention relates to a cleaning module and a printer using the same. Particularly, the invention relates to a cleaning module capable of scraping residual toner and a printer using the same.

2. Related Art

Along with quick development of electronic technology, printers become indispensable information products in today's office. FIG. 1 is a schematic diagram of a conventional printer. Referring to FIG. 1, the conventional printer 100 includes a toner cartridge assembly 110, a photo-conductor drum 120, a roller module 130, a transfer belt 140, a fuser module 150 and a cleaning module 160. During a printing process of the printer 100, the toner in the toner cartridge assembly 110 is adhered to the photo-conductor drum 120 at a position carrying static electricity (i.e. an image range to be printed). Then, the photo-conductor drum 120 transfer-prints the toner to the transfer belt 140. Moreover, the transfer belt 140 transfer-prints the toner to a paper. The toner on the paper is fixed through the high temperature and high pressure fuser module 150 so as to accomplish the printing process. After the printing is completed, the cleaning module 160 scraps the residual toner on the transfer belt 140.

Presently, when the residual toner on the transfer belt is cleaned, a solenoid valve is used to control a rubber scraper (a cleaning brush) to contact or separate from the transfer belt, and a sensor is used to detect whether the rubber scraper contacts the transfer belt, which is relatively expensive in manufacturing cost.

SUMMARY

The invention is directed to a cleaning module adapted to a printer. The cleaning module is capable of removing residual toner on a transfer belt after printing is completed without using a solenoid valve and a sensor, which avails effectively reducing the manufacturing cost.

The invention provides a printer, which uses the aforementioned cleaning module.

The invention provides a cleaning module adapted to a printer. The printer includes a roller module, a transfer belt and a toner cartridge assembly. The transfer belt is looped around the roller module. The toner cartridge assembly is disposed beside the transfer belt and is suitable for rotating to a standby position or a coloring position. The cleaning module includes a frame, a linking-up unit and a scraping unit. The frame is disposed at the roller module. The linking-up unit is pivotally connected to the frame and is suitable for contacting the toner cartridge assembly. The scraping unit is connected to the linking-up unit. When the toner cartridge assembly is at the standby position, the scraping unit contacts the transfer belt. When the toner cartridge assembly is at the coloring position, the scraping unit is separated from the transfer belt.

In an embodiment of the invention, the toner cartridge assembly has a contact surface and a contact portion sunken in the contact surface. When the linking-up unit contacts the contact surface, the scraping unit is separated from the transfer belt. When the linking-up unit contacts the contact portion, the scraping unit contacts the transfer belt.

In an embodiment of the invention, the toner cartridge assembly has a contact surface and a contact portion protruding from the contact surface. When the linking-up unit contacts the contact surface, the scraping unit contacts the transfer belt. When the linking-up unit contacts the contact portion, the scraping unit is separated from the transfer belt.

In an embodiment of the invention, the linking-up unit includes at least one gear pivotally connected to the frame. The toner cartridge assembly has a contact surface and a rack on a part of the contact surface. When the gear meshes with the rack, the scraping unit contacts the transfer belt.

In an embodiment of the invention, the cleaning module further includes an elastic unit disposed between the frame and the linking-up unit or between the roller module and the linking-up unit.

The invention provides a printer including a roller module, a transfer belt, a toner cartridge assembly and a cleaning module. The transfer belt is looped around the roller module. The toner cartridge assembly is disposed beside the transfer belt and is suitable for rotating to a standby position or a coloring position. The cleaning module includes a frame, a linking-up unit and a scraping unit. The frame is disposed at the roller module. The linking-up unit is pivotally connected to the frame and is suitable for contacting the toner cartridge assembly. The scraping unit is connected to the linking-up unit. When the toner cartridge assembly is at the standby position, the scraping unit contacts the transfer belt. When the toner cartridge assembly is at the coloring position, the scraping unit is separated from the transfer belt.

In an embodiment of the invention, the toner cartridge assembly has a contact surface and a contact portion sunken in the contact surface. When the linking-up unit contacts the contact surface, the scraping unit is separated from the transfer belt. When the linking-up unit contacts the contact portion, the scraping unit contacts the transfer belt.

In an embodiment of the invention, the toner cartridge assembly has a contact surface and a contact portion protruding from the contact surface. When the linking-up unit contacts the contact surface, the scraping unit contacts the transfer belt.

When the linking-up unit contacts the contact portion, the scraping unit is separated from the transfer belt.

In an embodiment of the invention, the linking-up unit includes at least one gear pivotally connected to the frame. The toner cartridge assembly includes a contact surface and a rack on a part of the contact surface. When the gear meshes with the rack, the scraping unit contacts the transfer belt.

In an embodiment of the invention, the printer further includes an elastic unit disposed between the frame and the linking-up unit or between the roller module and the linking-up unit.

In an embodiment of the invention, the cleaning module further includes an elastic unit disposed between the frame and the linking-up unit or between the roller module and the linking-up unit.

According to the above descriptions, according to a feature that the toner cartridge assembly rotates to the standby position when the printing is completed, when the toner cartridge assembly is at the standby position, the contact portion or the rack is configured at a part of the toner cartridge assembly corresponding to the linking-up unit, so that when the linking-up unit contacts the contact portion of the toner cartridge assembly or meshes with the rack, the linking-up unit rotates relative to the frame, and the scraping unit connected to the linking-up unit contacts the transfer belt. Since the roller module drives the transfer belt, the scraping unit can scrape the residual toner on the transfer belt. The cleaning module and the printer of the invention are unnecessary to use a solenoid valve and a sensor, which are convenient and economic.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

A toner cartridge assembly of a current monochrome printer or a color printer rotates to a coloring position (the toner cartridge assembly of the monochrome printer can be rotated to one coloring position, and the toner cartridge assembly of the color printer can be rotated to four coloring positions) to contact the toner with a photo-conductor drum during a printing process. After the printing is completed, the toner cartridge assembly of the monochrome printer or the color printer rotates to a standby position. In the invention, according to a feature that the toner cartridge assembly rotates to the standby position when the printing is completed, and based on a linkage relationship between the toner cartridge assembly and a cleaning module, a relative position between a scraping unit and a transfer belt is controlled, so as to remove the residual toner on the transfer belt.

Figure 1:
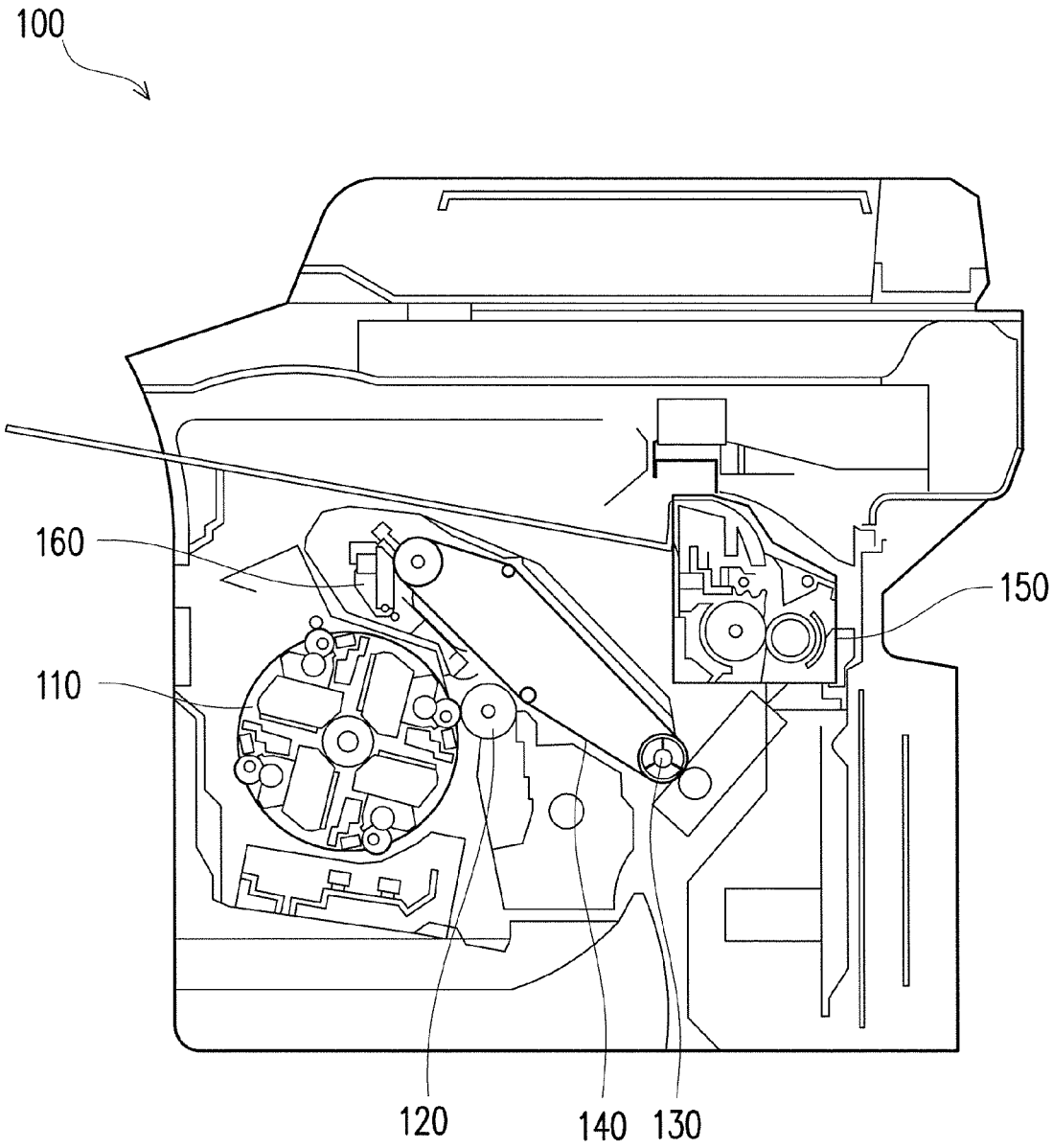
FIG. 1 (PRIOR ART)
FIG. 1 is a schematic diagram of a conventional printer.
Figure 2A:
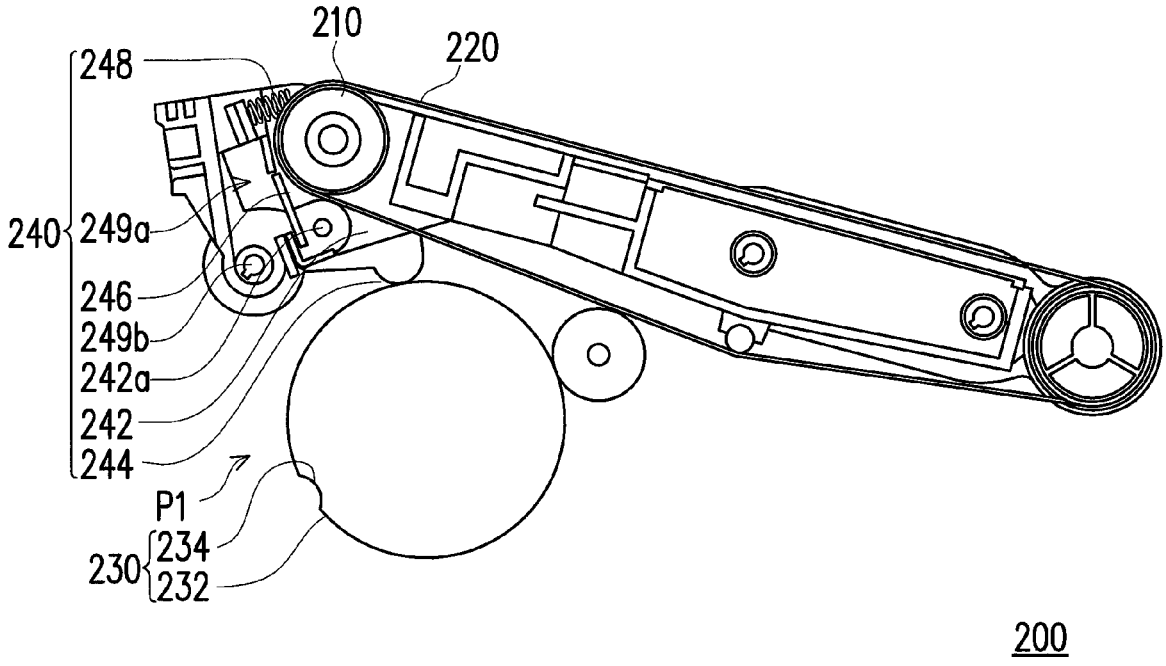
FIG. 2A is a partial perspective view of a toner cartridge assembly of a printer rotated to a coloring position according to an embodiment of the invention.
Figure 2B:
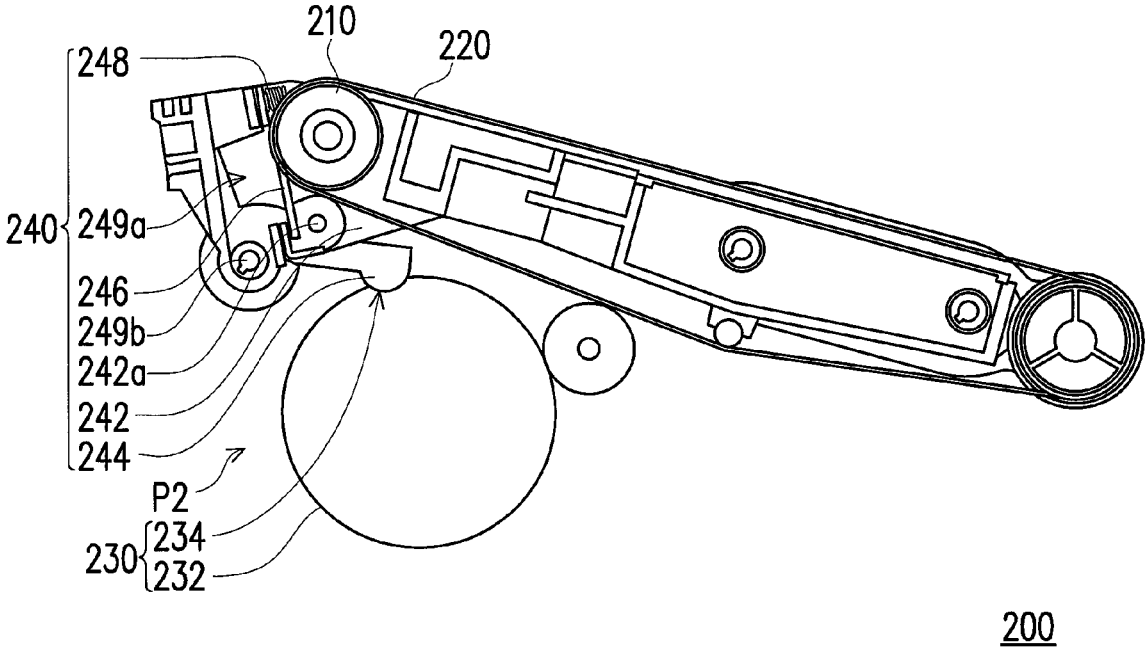
FIG. 2B is a partial perspective view of the toner cartridge assembly of the printer of FIG. 2A rotated to a standby position.

FIG. 2A is a partial perspective view of a toner cartridge assembly of a printer rotated to the coloring position according to an embodiment of the invention. FIG. 2B is a partial perspective view of the toner cartridge assembly of the printer of FIG. 2A rotated to the standby position. Referring to FIG. 2A and FIG. 2B, the printer 200 includes a roller module 210, a transfer belt 220, a toner cartridge assembly 230 and a cleaning module 240. The transfer belt 220 is looped around the roller module 210. The toner cartridge assembly 230 is disposed beside the transfer belt 220 and is suitable for rotating to a coloring position P1 (shown in FIG. 2A) or a standby position P2 (shown in FIG. 2B). The cleaning module 240 includes a frame 242, a linking-up unit 244 and a scraping unit 246. The frame 242 is disposed at the roller module 210. The linking-up unit 244 is pivotally connected to the frame 242. The linking-up unit 244 can rotate relative to a pivot 242*a* pivotally connected to the frame 242, and is suitable for contacting the toner cartridge assembly 230. The scraping unit 246 is connected to the linking-up unit 244. Therefore, the scraping unit 246 can rotate along with rotation of the linking-up unit 244.

In the present embodiment, the toner cartridge assembly 230 has a contact surface 232 and a contact portion 234 sunken in the contact surface 232. When the toner cartridge assembly 230 is at the coloring position P1, the linking-up unit 244 contacts the contact surface 232, and now the scraping unit 246 is separated from the transfer belt 220 (shown in FIG. 2A). When the printing is completed, the toner cartridge assembly 230 rotates to the standby position P2, and the linking-up unit 244 slides to the contact portion 234 along the contact surface 232. Since the contact portion 234 is sunken in the contact surface 232, due to a height difference there between, when the linking-up unit 244 slides to the contact portion 234 from the contact surface 232, the linking-up unit 244 pivotally rotates relative to the frame 242 (in the present embodiment, the linking-up unit 244 rotates by a certain angle clockwise). Accordingly, the scraping unit 246 connected to the linking-up unit 244 contacts the transfer belt 220 along with the rotation. Now, since the transfer belt 220 is driven by the roller module 210, the scraping unit 236 can scrape the residual toner on the transfer belt 220.

The cleaning module 240 of the present embodiment further includes an elastic unit 248. The elastic unit 248 can be disposed between the roller module 210 and the linking-up unit 244. The elastic unit 248 can be a spring. In the present embodiment, since elastic potential energy of the elastic unit 248 when the toner cartridge assembly 230 is at the standby position P2 is greater than elastic potential energy of the elastic unit 248 when the toner cartridge assembly 230 is at the coloring position P1, when the toner cartridge assembly 230 is to rotate to the coloring position P1, the elastic unit 248 can assist the linking-up unit 244 to return back to the contact surface 232 from the contact portion 234 of the toner cartridge assembly 230. Certainly, a type of the elastic unit 248 and a configuration method thereof are not limited by the present embodiment, and in other embodiments, the elastic unit 248 can also be disposed between the frame 242 and the linking-up unit 244.

Moreover, in the present embodiment, the printer 200 further includes a residual trough 249*a* and a screw 249*b*, where the residual trough 249*a* is located beside the scraping unit 246, and after the toner scraped by the scraping unit 246 falls in the residual trough 249*a*, the toner is transported out through rotation of the screw 249*b*. Moreover, the scraping unit 246 can be a scraper or a brush. Certainly, the type of the scraping unit 246 is not limited by the invention as long as it can remove the residual toner on the transfer belt 220.

In the printer 200 of the present embodiment, by configuring the contact portion 234 sunken in the contact surface 232 on the contact surface 232 of the toner cartridge assembly 230, when the toner cartridge assembly 230 rotates to the standby position P2, a contact area between the linking-up unit 244 and the toner cartridge assembly 230 is changed from the contact surface 232 to the contact portion 234. Since the contact surface 232 and the contact portion 234 have the height difference, the linking-up unit 244 pivotally rotates clockwise relative to the frame 242, and the scraping unit 246 connected to the linking-up unit 244 rotates to contact the transfer belt 220.

Similarly, when the toner cartridge assembly 230 rotates to the coloring position P1, the contact area between the linking-up unit 244 and the toner cartridge assembly 230 is changed from the contact portion 234 to the contact surface 232. The linking-up unit 244 rotates anticlockwise relative to the frame 242, and the scraping unit 246 is separated from the transfer belt 220.

Therefore, the cleaning module 240 of the printer 200 of the present embodiment is unnecessary to use a solenoid valve to control the operation of the scraping unit 246, and is also unnecessary to use a sensor to sense whether the scraping unit 246 contacts the transfer belt 220, so that the printer 200 of the present embodiment has a low manufacturing cost.

Figure 3:
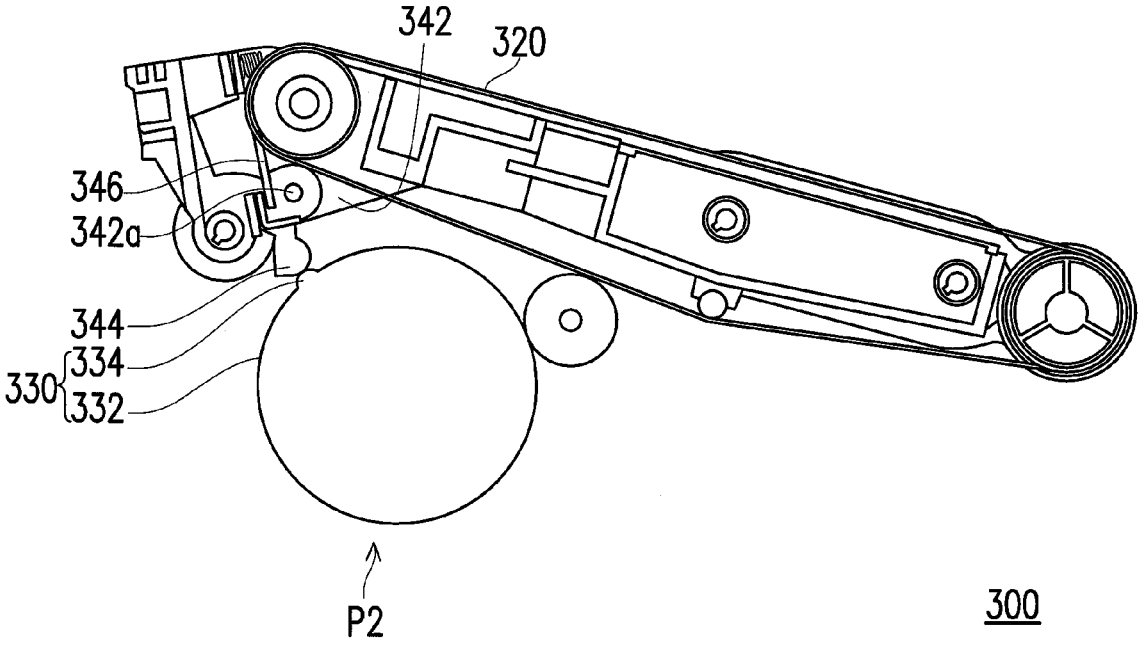
FIG. 3 is a partial perspective view of a toner cartridge assembly of a printer rotated to a standby position according to another embodiment of the invention.

FIG. 3 is a partial perspective view of a toner cartridge assembly of a printer rotated to the standby position according to another embodiment of the invention. Referring to FIG. 3, a main difference between the printer 300 of FIG. 3 and the printer 200 of FIG. 2A is that a contact portion 334 of a toner cartridge assembly 330 protrudes from a contact surface 332.

In FIG. 3, when the toner cartridge assembly 330 rotates to the standby position P2, a linking-up unit 344 contacts the contact portion 334, and a scraping unit 346 contacts a transfer belt 320 to scrape the residual toner. When the toner cartridge assembly 330 rotates to leave the standby position P2, a contact area between the linking-up unit 244 and the toner cartridge assembly 330 is changed from the contact portion 334 to the contact surface 332. Since the contact surface 332 and the contact portion 334 have the height difference, the linking-up unit 344 rotates anticlockwise relative to a pivot 342*a* pivotally connected to a frame 342, and the scraping unit 346 is separated from the transfer belt 320.

In the printer 200 of FIG. 2A and the printer 300 of FIG. 3, due to the height differences between the contact portions 234 and 334 and the contact surfaces 232 and 332 of the toner cartridge assemblies 230 and 330, the linking-up units 244 and 344 contacted to the toner cartridge assemblies 230 and 330 rotate relative to the frames 242 and 342, so that the scraping units 246 and 346 contact or are separated from the transfer belts 220 and 320. Certainly, the linking-up method of the scraping unit is not limited by the invention.

Figure 4:
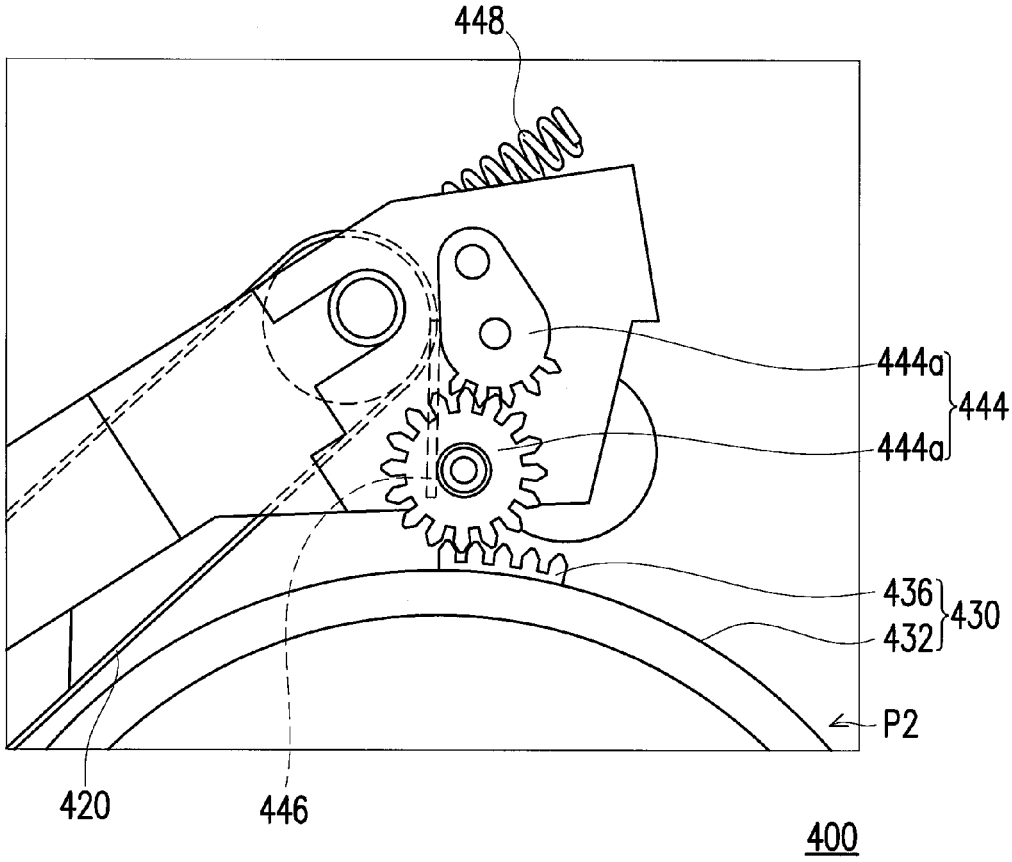
FIG. 4 is a partial perspective view of a toner cartridge assembly of a printer rotated to a standby position according to still another embodiment of the invention.

FIG. 4 is a partial perspective view of a toner cartridge assembly of a printer rotated to the standby position according to still another embodiment of the invention. Referring to FIG. 4, a main difference between the printer 400 of FIG. 4 and the printer 200 of FIG. 2A is that a linking-up unit 444 includes at least one gear 444*a*. As shown in FIG. 4, the linking-up unit 444 includes two gears 444*a*, and the two gears 444*a* are pivotally connected to a frame 442 and are meshed with each other. A toner cartridge assembly 430 includes a contact surface 432 and a rack 436 on a part of the contact surface 432.

As shown in FIG. 4, when the toner cartridge assembly 430 rotates to the standby position P2, one of the gears 444*a* meshes with the rack 436, and the two gears 444*a* are driven through the rack 436 to contact a scraping unit 446 with a transfer belt 420. In the present embodiment, when the toner cartridge assembly 430 is at the standby position P2, an elastic unit 448 is deformed to accumulate elastic potential energy. When the toner cartridge assembly 430 leaves the standby position P2, since the gear 444*a* of the linking-up unit 444 leaves the rack 436 of the toner cartridge assembly 430, the linking-up unit 444 is separated from the toner cartridge assembly 430. Now, the scraping unit 446 rotates to depart the transfer belt 420 through the elastic potential energy released by the elastic unit 448.

In summary, according to a feature that the toner cartridge assembly of the printer in the market rotates to the standby position when the printing is completed, when the toner cartridge assembly is at the standby position, the contact portion or the rack is configured at a part of the toner cartridge assembly corresponding to the linking-up unit, so that when the linking-up unit contacts the contact portion of the toner cartridge assembly or meshes with the rack, the linking-up unit rotates relative to the frame, and the scraping unit connected to the linking-up unit contacts the transfer belt. Since the roller module drives the transfer belt, the scraping unit continuously contacts the running transfer belt to scrape the residual toner on the transfer belt. The cleaning module and the printer of the invention are unnecessary to use a solenoid valve and a sensor, which are convenient and economic.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A cleaning module, adapted to a printer, wherein the printer comprises a roller module, a transfer belt and a toner cartridge assembly, the transfer belt is looped around the roller module, the toner cartridge assembly is disposed beside the transfer belt and is suitable for rotating to a standby position or a coloring position, the cleaning module comprising:

a frame, disposed at the roller module;

a linking-up unit, pivotally connected to the frame, and suitable for contacting the toner cartridge assembly; and a scraping unit, connected to the linking-up unit, wherein when the toner cartridge assembly is at the standby position, the scraping unit contacts the transfer belt, and when the toner cartridge assembly is at the coloring position, the scraping unit is separated from the transfer belt.

2. The cleaning module as claimed in claim 1, wherein the toner cartridge assembly has a contact surface and a contact portion sunken in the contact surface, when the linking-up unit contacts the contact surface, the scraping unit is separated from the transfer belt, and when the linking-up unit contacts the contact portion, the scraping unit contacts the transfer belt.

3. The cleaning module as claimed in claim 1, wherein the toner cartridge assembly has a contact surface and a contact portion protruding from the contact surface, when the linking-up unit contacts the contact surface, the scraping unit contacts the transfer belt, and when the linking-up unit contacts the contact portion, the scraping unit is separated from the transfer belt.

4. The cleaning module as claimed in claim 1, wherein the linking-up unit comprises at least one gear pivotally connected to the frame, the toner cartridge assembly has a contact surface and a rack on a part of the contact surface, and when the gear meshes with the rack, the scraping unit contacts the transfer belt.

5. The cleaning module as claimed in claim 1, further comprising:

an elastic unit, disposed between the frame and the linking-up unit or between the roller module and the linking-up unit.

6. A printer, comprising:

a roller module;

a transfer belt, looped around the roller module;

a toner cartridge assembly, disposed beside the transfer belt, and suitable for rotating to a standby position or a coloring position;

a cleaning module, comprising:

a frame, disposed at the roller module;

a linking-up unit, pivotally connected to the frame, and suitable for contacting the toner cartridge assembly; and a scraping unit, connected to the linking-up unit, wherein when the toner cartridge assembly is at the standby position, the scraping unit contacts the transfer belt, and when the toner cartridge assembly is at the coloring position, the scraping unit is separated from the transfer belt.

7. The printer as claimed in claim 6, wherein the toner cartridge assembly has a contact surface and a contact portion sunken in the contact surface, when the linking-up unit contacts the contact surface, the scraping unit is separated from the transfer belt, and when the linking-up unit contacts the contact portion, the scraping unit contacts the transfer belt.

8. The printer as claimed in claim 6, wherein the toner cartridge assembly has a contact surface and a contact portion protruding from the contact surface, when the linking-up unit contacts the contact surface, the scraping unit contacts the transfer belt, and when the linking-up unit contacts the contact portion, the scraping unit is separated from the transfer belt.

9. The printer as claimed in claim 6, wherein the linking-up unit comprises at least one gear pivotally connected to the frame, the toner cartridge assembly has a contact surface and a rack on a part of the contact surface, and when the gear meshes with the rack, the scraping unit contacts the transfer belt.

10. The printer as claimed in claim 6, wherein the cleaning module further comprises an elastic unit disposed between the frame and the linking-up unit or between the roller module and the linking-up unit.

* * * * *